United States Patent [19]

Weathers et al.

[11] 4,195,605

[45] Apr. 1, 1980

[54] EXHAUST GAS RECIRCULATION CONTROL

[75] Inventors: Lawrence M. Weathers, Warren; Carl A. Wellenkotter, Rochester, both of Mich.

[73] Assignee: General Motors Corporation, Detroit, Mich.

[21] Appl. No.: 900,173

[22] Filed: Apr. 26, 1978

[51] Int. Cl.[2] ..... F02M 25/06

[52] U.S. Cl. ..... 123/119 A; 123/117 A

[58] Field of Search ..... 123/119 A, 117 A

[56] References Cited

U.S. PATENT DOCUMENTS

| | | | |
|---|---|---|---|
| 3,800,764 | 4/1974 | Goto et al. | 123/119 A |
| 3,955,364 | 5/1976 | Lewis | 123/119 A |
| 3,962,868 | 6/1976 | Matumoto et al. | 123/119 A |
| 3,992,878 | 11/1976 | Moorman | 123/119 A |
| 4,050,423 | 9/1977 | Inada et al. | 123/117 A |
| 4,111,172 | 5/1978 | Nishizawa et al. | 123/119 A |
| 4,117,814 | 10/1978 | Takahashi | 123/119 A |

*Primary Examiner*—Wendell E. Burns
*Attorney, Agent, or Firm*—C. K. Veenstra

[57] ABSTRACT

In an internal combustion engine, an exhaust gas recirculation control assembly and an ignition timing control assembly are operated by an induction passage pressure signal transmitted through a control unit. The control unit interrupts the induction passage pressure signal to cut off exhaust gas recirculation and advance ignition timing following operation at an induction passage pressure signal below a particular level for a selected period of time, such as will occur when the engine powers a vehicle during highway driving.

2 Claims, 3 Drawing Figures

EXHAUST GAS RECIRCULATION CONTROL

This invention relates to a control unit for transmitting an engine air induction passage pressure signal to an engine exhaust gas recirculation control assembly.

Exhaust gas recirculation and limited advance of ignition timing have been developed as methods for inhibiting the formation and emission of oxides of nitrogen during the combustion process in an engine. While exhaust gas recirculation and limited advance of ignition timing lower the emission of oxides of nitrogen, they are accompanied by increases in fuel consumption. Accordingly, controls have been proposed for cutting off recirculation of exhaust gases and/or further advancing ignition timing during operating conditions which contribute little to the emission of oxides of nitrogen, such as those occurring when the engine powers a vehicle during highway driving, so that decreases in fuel consumption may be realized.

This invention provides a control unit which has been designed to transmit a pressure signal below a particular level from an engine air induction passage to an engine exhaust gas recirculation control assembly only for a selected period of time. Following operation at an induction passage pressure signal below the particular level for the selected period of time, this control unit interrupts that pressure signal and thereafter transmits an atmospheric pressure signal to the exhaust gas recirculation control assembly.

Vehicle engines typically provide low induction passage pressure signals for extended periods of time only during constant speed operating conditions such as those occurring during highway driving. Accordingly, when an engine exhaust gas recirculation (EGR) control assembly is operated by an induction passage pressure signal transmitted through this control unit, the EGR control assembly controls exhaust gas recirculation in a conventional manner in accordance with variations in the pressure signal except when the pressure signal is below a particular level for more than a selected period of time; when the induction passage pressure signal is below that level for that period of time, the control unit interrupts that pressure signal and the EGR control assembly then inhibits or cuts off exhaust gas recirculation so that a decrease in fuel consumption may be realized.

The details as well as other features and advantages of this invention are set forth in the remainder of the specification and are shown in the drawings in which.

Figure 1:
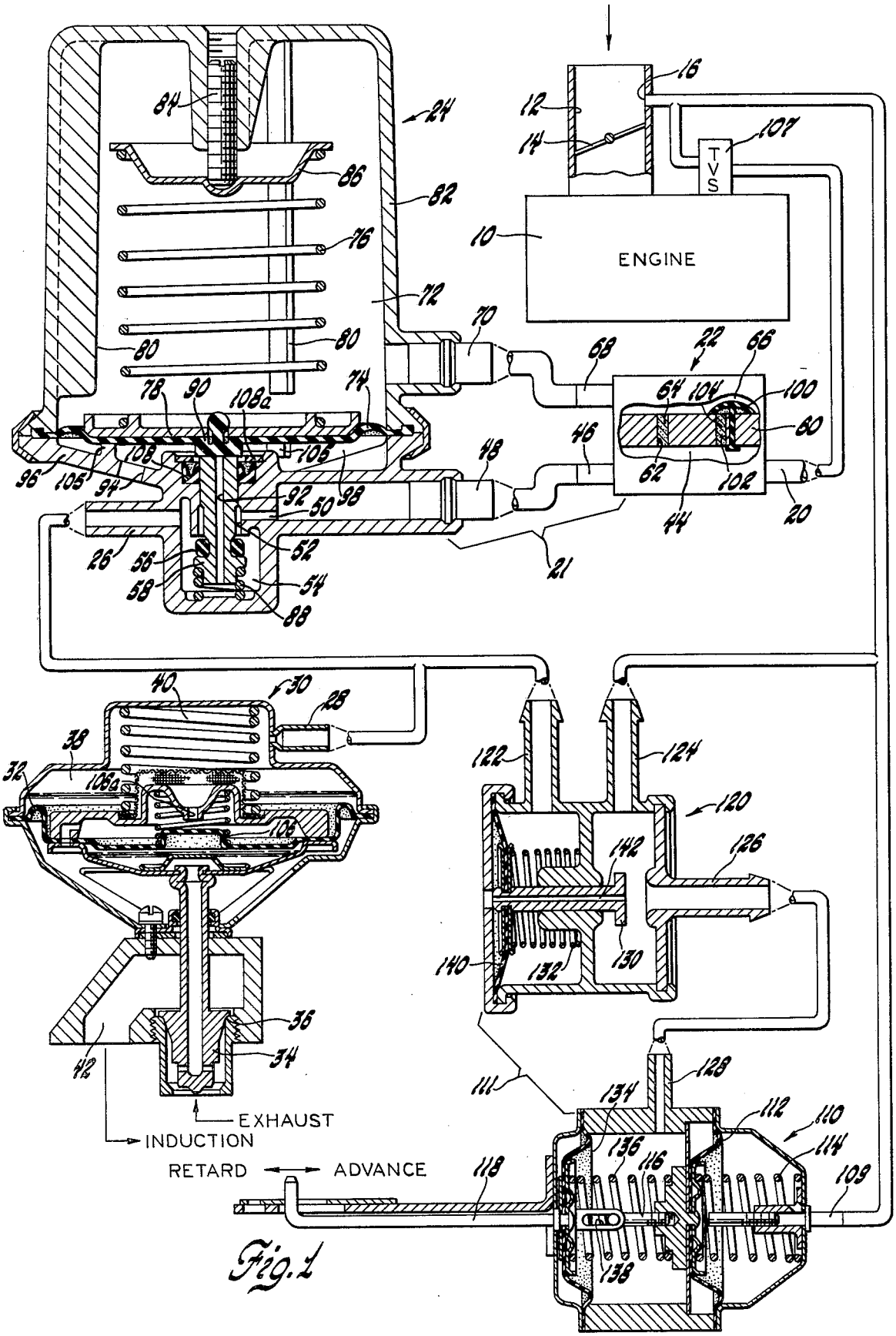
FIG. 1 is a schematic view of an engine in which a preferred embodiment of this control unit transmits an induction passage pressure signal to an exhaust gas recirculation control assembly and an ignition timing control assembly.

Referring first to FIG. 1, an internal combustion engine 10 has an air induction passage 12 controlled by a throttle 14. A port 16 in induction passage 12 senses an induction passage pressure signal adjacent the edge of throttle 14; during idle and other closed throttle modes of operation port 16 is upstream of throttle 14 and senses a substantially atmospheric pressure signal, while during open throttle modes of operation port 16 is downstream of throttle 14 and senses a pressure signal which at least at times is subatmospheric.

The pressure signal at port 16 is supplied to an inlet fitting 20 of a control unit 21 which includes a metering unit 22 and a valve unit 24. Control unit 21 has an outlet fitting 26 which transmits a pressure signal to the inlet fitting 28 of an exhaust gas recirculation (EGR) control assembly 30.

EGR control assembly 30 has a diaphragm 32 which lifts an EGR valve pintle 34 from its seat 36 when the pressure signal in the chamber 38 above diaphragm 32 is low enough to overcome the bias of a spring 40. Pintle 34 then allows recirculation of exhaust gases through an EGR passage 42 back to induction passage 12.

Within metering unit 22, it will be noted that inlet fitting 20 delivers the induction passage pressure signal through an inlet chamber 44 to an intermediate fitting 46 which is connected to an intermediate fitting 48 on valve unit 24. Within valve unit 24, fitting 48 extends to a port 50 which opens through a bore 52 to a chamber 54 connected to outlet fitting 26. An O-ring 56 carried on a stem 58 provides a valve element which controls the opening of bore 52 to chamber 54, and with stem 58 depressed as shown in the drawing, inlet fitting 20 is connected directly to outlet fitting 26 through inlet chamber 44, intermediate fittings 46 and 48, port 50, bore 52 and chamber 54 and the induction passage pressure signal is transmitted through control unit 21.

Metering unit 22 has a partition 60 with an opening 62 which is restricted by a sintered metal element 64. A chamber 66 above partition 60 is connected through an intermediate fitting 68 with an intermediate fitting 70 on valve unit 24. Fitting 70 opens to a reservoir chamber 72 within valve unit 24. When the induction passage pressure signal in metering unit inlet chamber 44 is less than the pressure in valve unit reservoir chamber 72, the pressure in chamber 72 is gradually decreased through intermediate fittings 70 and 68 and restricted opening 62. When the pressure in reservoir chamber 72 drops below a particular level, a diaphragm 74 which defines the lower portion of chamber 72 moves upwardly against the bias of a spring 76 and carries a diaphragm plate 78 into engagement with a plurality of ribs 80 spaced about the upper housing 82 of valve unit 24. An adjusting screw 84 may be turned on its threads to move a spring seat 86 which loads spring 76 and thereby establishes the particular pressure level below which diaphragm 74 will be lifted.

Valve stem 58 is biased upwardly by a spring 88 to follow diaphragm 74 so that when diaphragm 74 lifts against the bias of spring 76, spring 88 seats O-ring 56 across the end of bore 52 to interrupt flow between bore 52 and chamber 54. When O-ring 56 seats across the end of bore 52, the travel of valve stem 58 is stopped and a valve disc 90 carried by diaphragm 74 is displaced from the upper end of stem 58 and thus opens an atmospheric pressure bleed passage 92 which extends through stem 58. An atmospheric pressure signal now is transmitted through one or more openings 94 in the lower housing 96 of valve unit 24, through an atmospheric pressure chamber 98 below diaphragm 74, and through bleed passage 92, chamber 54 and outlet fitting 26 to EGR control assembly 30. Spring 40 then engages EGR valve pintle 34 with seat 36 to cut off recirculation of exhaust gases through EGR passage 42.

When the induction passage pressure signal in metering unit inlet chamber 44 increases, such as when throttle 14 is closed, an umbrella check valve 100 opens to allow flow through a second opening 102 formed in partition 60 and restricted by a sintered metal element 104. Thus after a predetermined time, flow through openings 62 and 102 will increase the pressure in reservoir chamber 72 above the particular level, allowing spring 76 to engage diaphragm unit 74 with a plurality of ribs 105 formed in lower housing 96. Valve disc 90 then seats across atmospheric pressure bleed passage 92 to interrupt flow through bleed passage 92 and pushes valve stem 58 downwardly against spring 88 to unseat O-ring 56 from the bottom of bore 52 and permit flow between outlet fitting 26 and inlet fitting 20.

Accordingly, before throttle 14 is opened from the idle position shown, an atmospheric induction passage pressure signal is transmitted from port 16 through control unit 21 to EGR control assembly 30, and spring 40 engages EGR valve pintle 34 with seat 36 to prevent recirculation of exhaust gases through EGR passage 42. As throttle 14 is opened, a subatmospheric induction passage pressure signal is transmitted from port 16 to EGR control assembly 30, and diaphragm 32 lifts pintle 34 to permit recirculation of exhaust gases through EGR passage 42. Restricted opening 62 gradually reduces the pressure in reservoir chamber 72 to the induction passage pressure signal over a selected period of time, and when that pressure signal is below a particular level, diaphragm 74 lifts to interrupt the induction passage pressure signal and to transmit an atmospheric pressure signal to EGR control assembly 30; spring 40 thereupon re-engages valve pintle 34 with valve seat 36 to cut off recirculation of exhaust gases through EGR passage 42.

Upon an increase in the induction passage pressure signal, such as may occur upon an increase in load or upon closure of throttle 14 to the position shown, umbrella valve 100 opens and flow through restricted openings 62 and 102 gradually increases the pressure in reservoir chamber 72. If the increase in the induction passage pressure signal is only temporary, the pressure in reservoir chamber 72 may not rise sufficiently to allow spring 76 to lower diaphragm 74 against ribs 105, and the atmospheric pressure bleed passage 92 will remain open; spring 40 therefore maintains valve pintle 34 engaged with valve seat 36 to prevent recirculation of exhaust gases through EGR passage 42. However, after a predetermined period of time, flow through restricted openings 62 and 102 increases the pressure in chamber 72 to allow spring 76 to lower diaphragm 74. Thereupon, closure of bleed passage 92 by valve disc 90 and displacement of O-ring 56 from bore 52 will allow transmission of the induction passage pressure signal to EGR control assembly 30.

When control unit 21 delivers an induction passage pressure signal to EGR control assembly 30, diaphragm 32 positions EGR valve pintle 34 in accordance with variations in the pressure signal in a conventional manner: when the pressure signal approaches atmospheric pressure (as during closed throttle and wide open throttle operation) spring 40 seats EGR valve pintle 34 to cut off recirculation of exhaust gases through EGR passage 42, and when the pressure signal is low enough to overcome the bias of spring 40, EGR valve pintle 34 is lifted from its seat 36 to permit recirculation of exhaust gases. However, when engine 10 is operated at an induction passage pressure signal below a particular level (for example, when the manifold vacuum in induction passage 12 downstream of throttle 14 is at least 8" Hg) for a selected period of time (for example, 140–160 seconds) such as will occur when engine 10 powers a vehicle during highway driving, EGR control assembly 30 prevents recirculation of exhaust gases through EGR passage 42 which leads to a decrease in highway fuel consumption.

It will be appreciated that the time required for flow through restricted opening 62 to reduce the pressure in reservoir chamber 72 sufficiently to lift diaphragm 74 depends upon the particular pressure level required to lift diaphragm 74. Accordingly, adjustment of screw 84 in the top of valve unit 24 (which establishes the particular pressure level required to lift diaphragm 74) serves to calibrate the selected period of time required to lift diaphragm 74 and thereby interrupt the induction passage pressure signal otherwise transmitted to EGR control assembly 30.

If desired, EGR control assembly 30 may include a diaphragm valve 106 which controls an air bleed **106*a* into chamber 38 in accordance with the pressure in EGR passage 42 below valve pintle 34. Thus when a subatmospheric induction passage pressure signal is delivered to EGR control assembly 30, diaphragm 32 positions valve pintle 34 to control recirculation of exhaust gases in a manner assuring a substantially constant pressure below pintle 34; exhaust gas recirculation accordingly is a function of the engine exhaust backpressure, and since exhaust backpressure is a function of air flow through induction passage 12**, exhaust gas recirculation is proportioned to induction air flow.

Moreover, a thermal vacuum switch (TVS) 107 may interrupt the induction passage pressure signal to prevent recirculation of exhaust gases during low temperature engine operation.

It also will be appreciated that a filter may be provided for the air which bleeds through openings 94 and chamber 98 to bleed passage 92. In addition, a lip seal 108 may be provided about valve stem 58 and retained by a star washer **108*a***.

The induction passage pressure signal at port 16 is also applied to a primary fitting 109 of an ignition timing vacuum advance motor 110 which forms a portion of an ignition timing control assembly 111. During open throttle operation a primary diaphragm 112 is retracted against a spring 114 and a stem 116 secured to diaphragm 112 retracts a link 118 which is connected to advance the ignition timing. However, when EGR control assembly 30 prevents recirculation of exhaust gases through EGR passage 42, the ignition timing may be further advanced to realize a further decrease in fuel consumption. Accordingly, ignition timing control assembly 111 also includes a switching valve 120 which has a fitting 122 connected to control unit outlet fitting 26, a fitting 124 also sensing the induction passage pressure signal at port 16, and a fitting 126 connected to a secondary fitting 128 on vacuum advance motor 110. Within switching valve 120 a valve member 130 is biased by a spring 132 to permit application of the induction passage pressure signal from port 16 through fittings 124, 126 an l 128 to a secondary diaphragm 134 which is secured to link 118. Diaphragm 134 is then retracted against a spring 136 to further retract link 118 for additional advance of the ignition timing, a slot 138 in link 118 allowing relative motion between link 118 and primary diaphragm stem 116.

When control unit 21 transmits the subatmospheric induction passage pressure signal to EGR control assembly 30, a diaphragm 140 within switching valve 120 responds to that pressure signal and engages valve member 130 across fitting 126 to interrupt the induction passage pressure signal applied to secondary diaphragm 134. A vent opening 142 through valve member 130 then exposes secondary diaphragm 134 to atmospheric pressure, and spring 136 moves secondary diaphragm 134 to the position shown.

Figure 2:
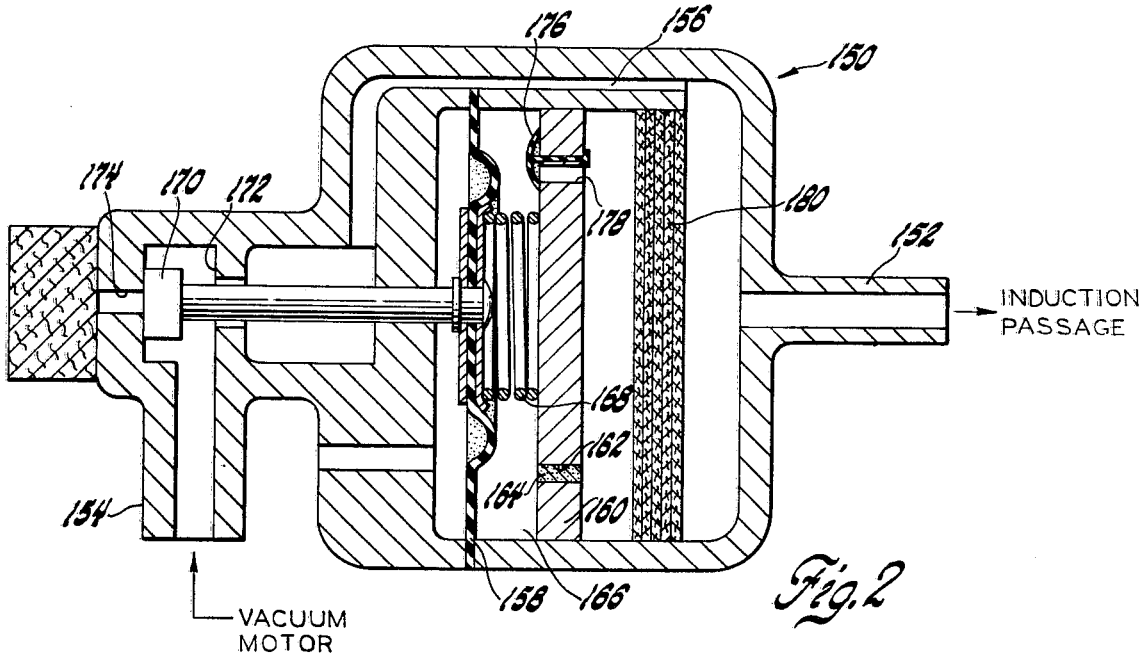
FIG. 2 shows an alternative embodiment of this control unit.

FIG. 2 illustrates a control unit 150 which is an alternative embodiment of control unit 21. Control unit 150 has an inlet fitting 152 for connection to port 16 and an outlet fitting 154 for connection to EGR control assembly 30. A passage 156 connects inlet fitting 152 and outlet fitting 154 to transmit the induction passage pressure signal to EGR control assembly 30. A diaphragm 158 is separated from inlet fitting 152 by a partition 160 having an opening 162 restricted by a sintered metal element 164. Flow through restricted opening 162 will gradually reduce the pressure in the chamber 166 between diaphragm 158 and partition 160; when the pressure in chamber 166 drops below a particular level, diaphragm 158 will be retracted against the bias of a spring 168 and will move a valve element 170 rightwardly against a seat 172, blocking passage 156 to interrupt the induction passage pressure signal and opening an atmospheric pressure bleed 174.

When the induction passage pressure signal in inlet fitting 152 increases, an umbrella check valve 176 opens to allow flow through an opening 178. This increases the pressure in chamber 166 and allows spring 168 to displace diaphragm 158 leftwardly, engaging valve element 170 across bleed 174 and permitting flow between outlet fitting 154 and inlet fitting 152. A filter 180 may be employed to prevent plugging of openings 162 and 178.

Figure 3:
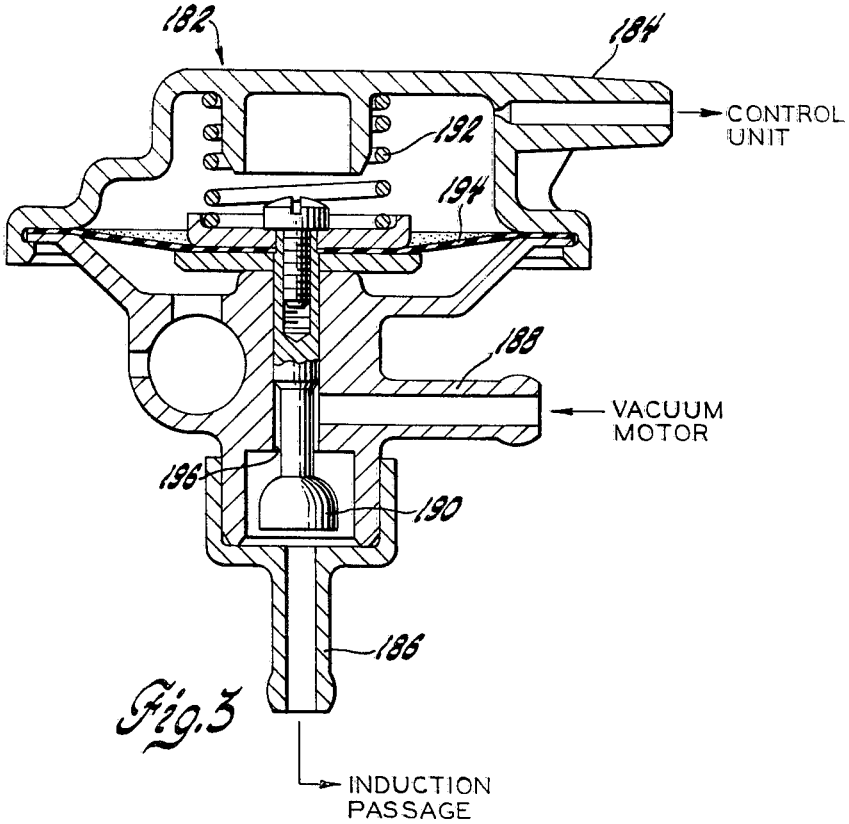
FIG. 3 shows an alternative embodiment of a switching valve used in the FIG. 1 ignition timing control assembly.

FIG. 3 shows a switching valve 182 which is an alternative embodiment of switching valve 120. Switching valve 182 has a fitting 184 for connection to the control unit outlet fitting 26 or 154, a fitting 186 for sensing the induction passage pressure signal at port 16, and a fitting 188 for connection to secondary fitting 128 on vacuum advance motor 110. A valve member 190 is biased by a spring 192 to permit application of the induction passage pressure signal from port 16 through fittings 186 and 188 to the secondary fitting 128 of vacuum advance motor 110, but when a diaphragm 194 receives a subatmospheric pressure signal from control unit outlet fitting 26 or 154, it retracts valve member 190 against the bias of spring 192 to engage valve member 190 across a bore 196 and thus interrupt flow between fittings 186 and 188.

The embodiments of the invention in which an exclusive property or privilege is claimed are defined as follows:

1. In an engine having an air induction passage, a recirculation passage for delivering exhaust gases to said induction passage, and an assembly permitting flow through said recirculation passage in response to a subatmospheric pressure signal and inhibiting flow through said recirculation passage in response to an atmospheric pressure signal: the improvement comprising a control unit having an inlet sensing a pressure signal in said induction passage which at least at times is subatmospheric, an outlet transmitting a pressure signal to said assembly, an atmospheric pressure bleed, valve means biased to a position inhibiting flow between said outlet and said bleed and permitting flow between said outlet and said inlet for transmitting said induction passage pressure signal to said assembly and movable to a second position permitting flow between said outlet and said bleed for transmitting an atmospheric pressure signal to said assembly, a diaphragm defining a portion of a chamber and responsive to pressure in said chamber below a certain level for effecting movement of said valve means to the second position, and a restricted opening connecting said chamber to said inlet for decreasing the pressure in said chamber below said level over at least a selected period of time, whereby said unit transmits said induction passage pressure signal to said assembly to thereby cause said assembly to permit flow through said recirculation passage for at least the selected period of time and thereafter transmits an atmospheric pressure signal to said assembly to thereby cause said assembly to inhibit flow through said recirculation passage.

2. In an engine having an air induction passage, a recirculation passage for delivering exhaust gases to said induction passage, and an assembly permitting flow through said recirculation passage in response to a subatmospheric pressure signal and inhibiting flow through said recirculation passage in response to an atmospheric pressure signal: the improvement comprising a control unit having an inlet sensing a pressure signal in said induction passage which at least at times is subatmospheric, an outlet transmitting a pressure signal to said assembly, an atmospheric pressure bleed, valve means biased to a position inhibiting flow between said outlet and said bleed and permitting flow between said outlet and said inlet for transmitting said induction passage pressure signal to said assembly and movable to a second position inhibiting flow between said outlet and said inlet and permitting flow between said outlet and said bleed for transmitting an atmospheric pressure signal to said assembly, a diaphragm defining a portion of a chamber and responsive to pressure in said chamber below a certain level for effecting movement of said valve means to the second position, a restricted opening connecting said chamber to said inlet for decreasing the pressure in said chamber below said level over at least a selected period of time whereby said unit transmits said induction passage pressure signal to said assembly to thereby cause said assembly to permit flow through said recirculation passage for at least the selected period of time and thereafter transmits an atmospheric pressure signal to said assembly to thereby cause said assembly to inhibit flow through said recirculation passage, a second opening connecting said chamber to said inlet for equalizing the pressure in said chamber with the induction passage pressure signal in said inlet, and a check valve permitting flow through said second opening only from said inlet to said chamber whereby the pressure in said chamber may increase upon an increase in said induction passage pressure signal.

* * * * *